United States Patent [19]
Campbell et al.

[11] 4,210,511
[45] Jul. 1, 1980

[54] ELECTROLYZER APPARATUS AND ELECTRODE STRUCTURE THEREFOR

[75] Inventors: Barrie C. Campbell, Payson; Harold M. Simons, Orem, both of Utah

[73] Assignee: Billings Energy Corporation, Provo, Utah

[21] Appl. No.: 17,681

[22] Filed: Mar. 8, 1979

[51] Int. Cl.[2] ..... C25B 9/00; C25B 11/03; C25B 11/04

[52] U.S. Cl. ..... 204/256; 204/258; 204/266; 204/283; 204/290 R; 204/290 F; 204/292; 204/294

[58] Field of Search ..... 204/263, 265, 266, 268, 204/269, 270, 264, 253–258, 282–283, 129, 290 F, 292, 294; 429/34, 35, 37, 39

[56] References Cited

U.S. PATENT DOCUMENTS

| | | | |
|---|---|---|---|
| 2,928,783 | 3/1960 | Bacon | 204/129 X |
| 3,298,867 | 1/1967 | Diotaleui | 429/39 |
| 3,462,307 | 8/1969 | Voorhies et al. | 429/37 X |
| 4,056,452 | 11/1977 | Campbell | 204/282 X |
| 4,124,478 | 11/1978 | Tsien et al. | 204/279 X |

*Primary Examiner*—John H. Mack
*Assistant Examiner*—D. R. Valentine
*Attorney, Agent, or Firm*—Thorpe, North & Gold

[57] ABSTRACT

Electrolysis apparatus and electrode structure comprising a solid polymer electrolyte membrane, a porous cathode plate, and a porous anode plate which is electrochemically compatible with the cathode, so that the anode plate and cathode plate are substantially immune from galvanic corrosion. The solid polymer electrolyte membrane is disposed between the anode plate and cathode plate, and means are provided for holding the anode and cathode plates in firm contact with the opposite sides, respectively, of the membrane. In an embodiment employing a plurality of sets of electrode structures means are provided for securing the anode plate, solid polymer electrolyte membranes, and cathode plate of each electrode structure in side-by-side relationship and to secure the respective electrode structures in spaced series arrangement, with a spacer plate positioned between the individual sets of spaced electrode structures. A series of grooves is provided between the anode plate and the plate in contact therewith. The grooves extend in generally parallel relationship across the interface of the anode plate and the other plate. Means are provided for supplying water to the mutually respective ends of the grooves associated with the anode plates and for withdrawing water and electrolysis products produced at the anode from the opposite ends of the grooves. A direct current source supplies current to the anode and cathode plates to cause an electrolytic reaction when water is supplied to the grooves. Water and electrolysis products are withdrawn from the cathode plates through an aligned bore extending through the electrode structures.

21 Claims, 4 Drawing Figures

ELECTROLYZER APPARATUS AND ELECTRODE STRUCTURE THEREFOR

BACKGROUND OF THE INVENTION

1. Field

This invention relates to electrolysis apparatus and to electrode structures in such apparatus.

2. State of the Art

As a result of recent shortages in hydrocarbon fuels and the recognition that the supply of such fuels will ultimately be exhausted, there has naturally been an increased interest in finding and developing alternative fuels. Hydrogen, being one of the most abundant of all elements and being relatively pollution free when burned, is considered one of the more attractive alternatives to hydrocarbon fuels, and electrolysis is considered one of the more attractive and economically feasible methods of producing hydrogen.

Prior art electrolytic cells have typically included a container of some type for holding a liquid electrolyte and a pair of electrodes immersed in the electrolyte. Application of direct current across the electrodes produces an electrochemical reaction in which the electrolyte is decomposed into one or more gaseous products. For example, with an aqueous electrolyte, oxygen and hydrogen may be produced.

Because of the inefficiencies, portability drawbacks, and unreliability of the liquid electrolyte cells, considerable interest has centered on a fairly new technology involving solid polymer electrolytes (SPE). See, for example, "Solid Electrolytes Offer Route to Hydrogen", Chemical and Engineering News, Aug. 27, 1973; "Electrolytic Hydrogen Fuel Production with Solid Polymer Electrolyte Technology" by W. A. Titterinton and A. P. Fickett, VIII IECEC Proceedings; and "A Hydrogen-Energy System", published by American Gas Association, 1973. As described in these references, SPE is typically a solid plastic sheet of perfluorinated sulfonic acid polymer which, when saturated with water, becomes an excellent ionic conductor. The ionic conductivity results from the mobility of the hydrogen ions which move through the polymer sheet by passing from one sulfonic acid group to another. An anode and cathode are positioned on either side of the sheet and pressed thereagainst to form the desired SPE cell.

Hydrogen is produced by the SPE cell by supplying water to the anode where it is electrochemically decomposed to provide oxygen, hydrogen ions, and electrons. The hydrogen ions move through the SPE sheet to the cathode while the electrons pass through the external circuit. At the cathode, the hydrogen ions and the electrons recombine electrochemically to produce hydrogen gas.

Although the prior art SPE cell described provides a reliability and efficiency not achieved with the liquid electrolyte cell, the cell requires noble metal catalysts and is subject to breakdown much more frequently than is desirable.

Improved electrolysis apparatus utilizing the SPE cell is described in U.S. Pat. No. 4,056,452 issued to one of the applicants herein, Barrie C. Campbell, on Nov. 1, 1977. In that patent, electrolysis apparatus is disclosed having a solid polymer electrolyte membrane and a pair of electrodes disposed on either side of and in contact with the membrane. At least one of the electrodes includes a corrugated portion which presents alternating ridges and grooves. The top of the ridges are maintained in contact with the membrane and the bottoms of the grooves are spaced from the membranes to enable the flow of fluid through the grooves.

3. Objectives

It is a principal objective of the present invention to provide an improved electrolysis apparatus which is more reliable and less costly than the apparatus of the prior art. A further objective is to provide electrolysis apparatus which has improved means for supplying fluid to the anode and cathode plates, as well as improved means for withdrawing fluid and electrolysis products separately from the anode and cathode plates. A still further objective is to provide electrolysis apparatus comprising a plurality of electrolytic cells in a compact and efficient series arrangement wherein corrosion due to galvanic action within and between cells is essentially eliminated. Additional objectives are to provide maximum surface area of the electrodes in contact with the solid polymer electrolyte membrane, and to provide apparatus capable of sustained, reliable operation at high pressures.

SUMMARY OF THE INVENTION

The above and other objects of the present invention are realized in an electrolysis apparatus comprising a single cell or a plurality of cells arranged in series. Each cell comprises an electrode structure made up of an anode plate, a cathode plate, and a solid polymer electrolyte membrane. Means are provided for securing the cathode plate, anode plate, and solid polymer electrolyte membrane of each electrode structure together in side-by-side relationship. Self-contained, single-celled units can be made containing a single electrode structure. Such single-celled units can be wired in a series arrangement to form a series of cells in accordance with this invention. However, it is advantageous and preferable to assemble a plurality of cells together as a unitary multi-celled unit, wherein spacer plates are positioned between the anode and cathode plates of adjacent cells and the means for securing the components of the electrode structure of each cell together is also adapted to secure the respective cells together in series arrangement with the spacer plates being positioned between adjacent cells in the series.

In accordance with the invention each individual cell comprises an anode plate having at least one substantially flat side which is in contact with one side of a solid polymer electrolyte membrane. The other side of the membrane is in contact with one side of a cathode plate. The cathode and anode plates are each fabricated from porous, electrically conductive material such that the cathode and anode plates are not substantially affected by galvanic corrosion when simultaneously brought into contact with the electrolyte. The cathode and anode plates can be made from different materials if the materials generate at most only a very small voltage therebetween when they are brought into contact with an electrolyte, such as, for example, sintered titanium and sintered titanium alloy. Preferably, the cathode and anode plates are made from the same material to avoid any problem of galvanic corrosion.

In the embodiment of the invention comprising a single cell, the sides of the anode plate and cathode plate which face outwardly from the solid polymer electrolyte membrane contact the respective sides of a pair of retainer plates positioned on the opposite ends of the cell. In the embodiment of the invention including a plurality of the cells arranged in series, the anode plate and cathode plate of the end cells of the series contact the respective sides of a pair of retainer plates positioned on the opposite ends of the series of cells. Within the series of cells, a spacer plate is positioned between the cathode of one cell and the anode of the adjacent cell. The spacer plate is made of the same materials which can be used in fabricating the anodes and electrodes but which is nonporous. In each cell, a series of grooves is provided between the anode plate and the spacer plate or retainer plate which is in contact with the side of the anode plate facing away from the solid polymer electrolyte membrane. The grooves can be formed in either the face of the anode plate or the face of the plate in contact with the anode plate, with the grooves extending in generally parallel relationship across the interface between the anode plate and the other plate from one edge or side of the cell to the other edge or side of the cell.

The cathode plate, anode plate, and solid polymer electrolyte membrane of each cell has a bore therethrough, and the cell is assembled so that the respective bores are all in alignment, thereby forming a collection cavity extending substantially through the cell. When multiple cells are arranged in series, the spacer plate positioned between adjacent cells is also provided with a bore, with the bores in the cells and the spacer plates being aligned to form an elongate, generally cylindrical shaped, collection cavity extending substantially from one end to the other end of the series of cells. The collection cavity is used to receive fluid and electrolysis products from the cathode plates. A liquid, such as water, which is to be electrolyzed is circulated through the grooves at the anode plates, and a portion of the liquid makes its way through the porous, sintered anode plates to the interface between the anode plates and the solid polymer electrolyte membranes. Electrolysis products, such as oxygen, generated at the surface of the anode plate which is adjacent to the solid polymer electrolyte membrane passes back through the porous anode plates and is removed from the cell by the liquid flowing through the grooves therein. Electrolysis products, such as hydrogen, produced at the surface of the cathode plate pass through the porous cathode plate to the collection cavity in the cell and are then removed from the cell by appropriate means.

BRIEF DESCRIPTION OF THE DRAWINGS

A preferred embodiment of electrolysis apparatus and electrode structure therefor of this invention representing the best mode presently contemplated of carrying out the invention in actual practice is illustrated in the accompanying drawings in which.

DETAILED DESCRIPTION OF THE ILLUSTRATED EMBODIMENT

Figure 1:
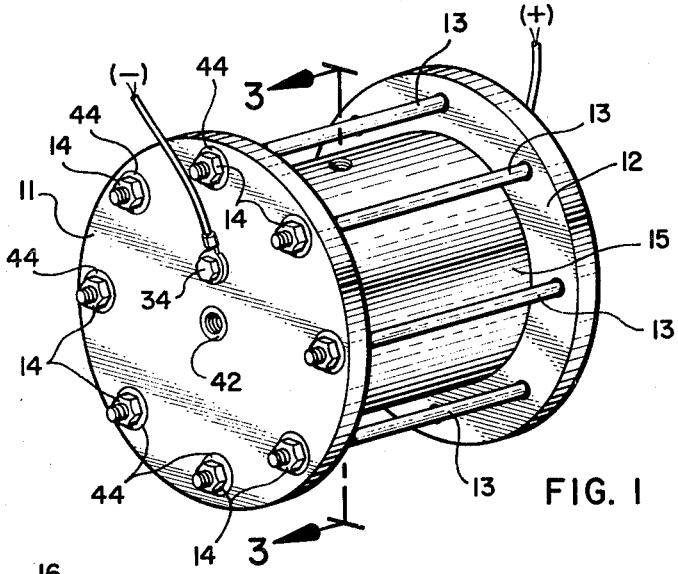
FIG. 1 is a perspective view of the preferred apparatus.

A preferred embodiment of electrolysis apparatus of this invention is shown in the drawings. An assembled unit is illustrated in FIG. 1. The unit comprises a pair of end plates 11 and 12. The end plates 11 and 12 are urged together by tie bolts 13 which extend through openings spaced around the outer portion of the end plates. As will be described hereinafter, the tie bolts 13 are electrically insulated from the end plates 11 and 12. The tie bolts are secured by nuts 14. A cylindrical housing 15, which will be more fully described hereinafter is positioned around the series of cells in the unit between the end plates 11 and 12.

Figure 2:
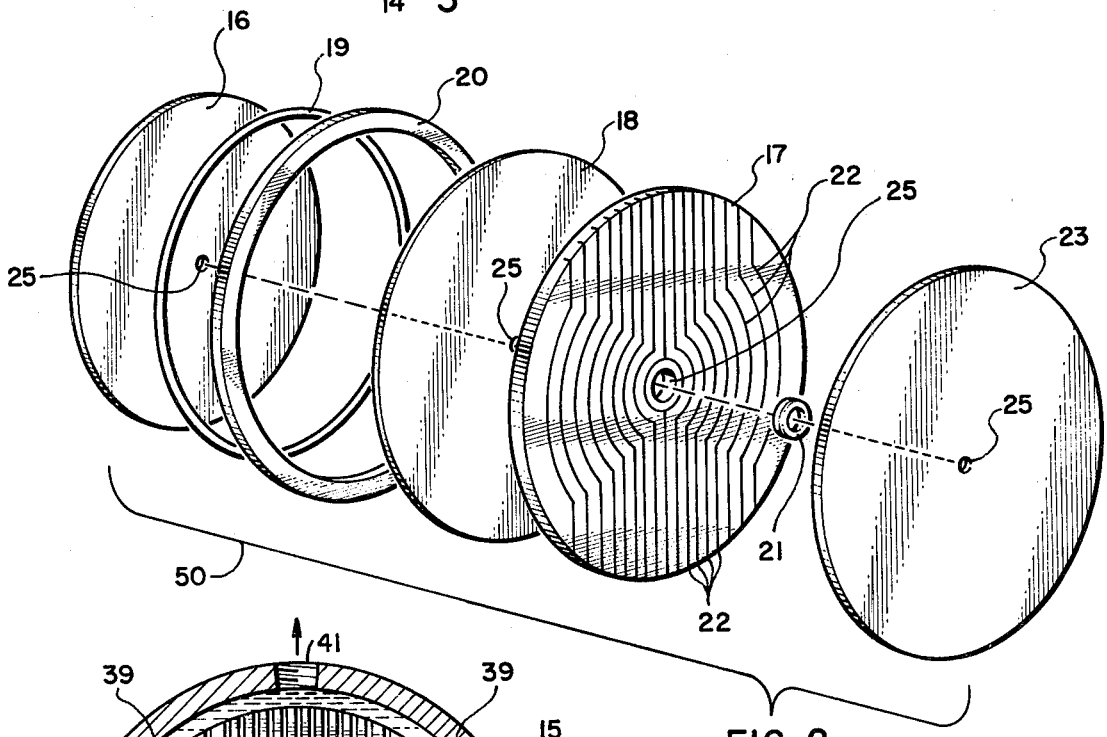
FIG. 2 is an exploded perspective of a typical cell structure as used in the apparatus of FIG. 1.
Figure 4:
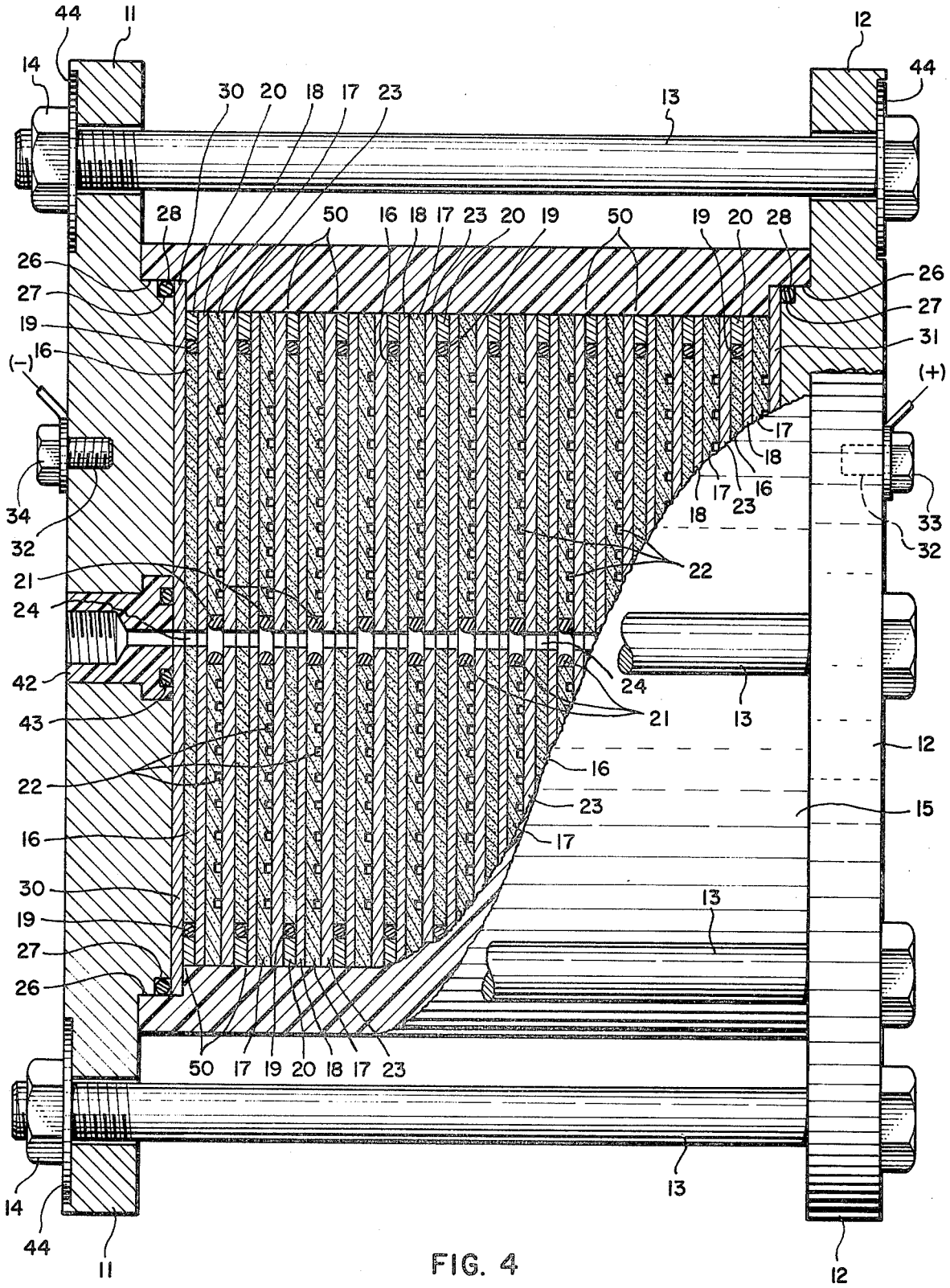
FIG. 4 is a side elevational view, partially cut away with the cut away portion shown in vertical cross-section.

The unit is shown in partly cut away and in cross-section in FIG. 4 to illustrate the assembly of cells therein, and an exploded perspective of an individual cell construction is shown in FIG. 2 Referring in particular to FIG. 2, each cell comprises a cathode plate 16 and an anode plate 17 positioned on opposite sides of a solid polymer electrolyte membrane 18. The cathode and anode plates 16 and 17 are made from a porous, electrically conductive material such as sintered nickel, titanium, graphite, and mixtures thereof. The membrane 18 may be made of any solid polymer electro'yte material, and it has been found that perfluorosulfonic acid membranes sold under the trademark "Nafion" by E. I. DuPont de Nemours and Company are especially desirable. In a preferred embodiment, the cathode and anode plates 16 and 17 are made from sintered titanium. As illustrated, the components of the individual cells have circular perimeters so that in the assembled form, the multi-cell, core structure has a generally cylindrical shape.

As illustrated in FIGS. 2 and 4, each cell unit has an annular sealing ring 19 such as an o-ring, made of teflon, ethylene-propylene copolymer or other applicable elastomeric material, positioned around the perimeter of the of the cathode plate 16, with a flat, retainer ring 20, which has essentially the same thickness as the cathode plate 16, fitting around the perimeter of the sealing ring 19. One side of each of the cathode plates 16 contacts one side of a mutually respective membrane 18. The membranes 18 are larger in diameter than the cathode plates 16, with the perimeter of the membranes 18 being substantially coterminous with the perimeters of the retainer rings 20. The other sides of the respective membranes 18 are in contact with mutually respective anode plates 17. The anode plates 17 are substantially coterminous with the perimeter of the membranes 18. A series of grooves are provided between the anode plates 17 and the separator plates 23, respectively. The grooves 22 as illustrated extend in general parallel relationship across the surface of the anode plate 17. Alternatively, the grooves 22 could also be cut in the surface of the separator plates 23, and in either alternative, the grooves are arranged, for purposes to be described hereinafter, to extend from one edge of the respective electrode structure to the other edge thereof. The grooved sides of the illustrated anode plates 17 are in contact with respective, flat, separator plates 23. The separator plates 23 are made of any of the materials from which the cathode and anode plates 16 and 17 can be made, but the separator plates 23 are fabricated so that they are not porous. Thus, whereas the cathode and anode plates 16 and 17 are made of sintered material, such as sintered titanium, the separator plates 23 are fabricated from solid material such as titanium sheet.

An elongate flow passage or cavity 24 extends through the cell structure from one end of the series of cells as shown in FIG. 4 to the other end. The elongate cavity 24 is formed from bores 25 (FIG. 2) through each of the cathode plates 16, membranes 18, separator plates 23, and anode plates 17. These bores are concentrically aligned when the cells are assembled so as to form the elongate cavity 24 as shown in FIG. 4. The respective bores 25 in the anode plates 17 have larger diameters than the corresponding bores 25 in the membranes 18 and separator plates 23. Thus, in the assembled cells, an indented annular groove is formed around the cylindrical wall of the flow passage or cavity 24 between each pair of separator plates 23 and membranes 18. A second annular gasket 21, such as a D-ring as shown in FIGS. 2 and 4, is positioned within the bore 25 in each of the anode plates 17 and, thus, within the annular groove formed between each pair of separator plates 23 and membranes 18. The D-ring 21 is made of polytetrafluoroethylene, ethylene-propylene copolymers, or other applicable elastomeric material.

As shown in FIG. 4, the cells are secured together in firm, side-by-side series engagement with separator plates 23 positioned between respective anode plates 17 and cathode plates 16. A typical, repeating cell structure is shown by the reference numeral 50 in FIG. 4. For purposes of clarity, only the components of the one cell structure 50 are identified by their respective reference numerals. The series of cells is secured together in series arrangement between end plates 11 and 12 and contained within housing 15. The end plates 11 and 12 are machined so as to provide lips 26 (FIG. 4) around the inside surfaces thereof. The lips 26 fits snugly within the mutually respective open ends of the cylindrical housing 15. Annular slots 27 (FIG. 4) are cut in the respective lips 26, and an O-ring gasket 28 (FIG. 4) is positioned within each of the slots 27. Retainer plates 30 and 31 are fitted in the open ends of the housing 15, respectively. The retainer plate 30 as shown in FIG. 4 has a bore therethrough which is in flow communication with the flow passage or cavity 24 in the series of cells. The other retainer plate 31 need not be provided with such a bore.

When the end plates 11 and 12 are urged towards each other by tightening the nuts 14 on the tie bolts 13, the inwardly facing surface of the plates 11 and 12 make firm contact with the retainer plates 30 and 31, respectively. A sufficient number of cell units are arranged in series within the housing 15 so that the cells are held tightly together by the inward pressure of the retainer plates 30 and 31. The O-ring gaskets 28 seal the end plates 11 and 12 in fluid tight seal with the housing 15.

Means are provided for connecting a direct current source to the end plates 11 and 12 of the electrolysis apparatus to provide the necessary current through the series of cells positioned within the housing 15. As shown, threaded bores 32 are provided in the end plates 11 and 12. A source of positive voltage is applied to the end plate 12 by a lug 33 which is threaded in the bore 32. An electrical conductor is attached to the lug 33 and supplies the positive voltage. A source of less positive voltage (shown in FIG. 4 as a conductor supplying negative voltage) is applied to the end plate 11 by a lug 34 which is threaded in the bore 32 in plate 11. An electrical conductor is attached to the lug 34 and supplies the less positive voltage thereto.

A current is passed from the end plate 12 through retainer plate 31 to the series of cells in the housing 15. Current passes from the anode to the cathode of each cell in the series of cells. The voltage potential across the apparatus from end plate 12 to end plate 11 is theoretically evenly divided across the series of cells contained in the housing 15. For example, each of the 12 cells in the apparatus of FIG. 4 would theoretically have a voltage potential between the cathode and anode thereof equal to approximately 1/12 the voltage potential applied across the apparatus from the end plate 11 to the end plate 12. In actual operation small voltage discrepancies may occur from cell to cell depending on the operation and the condition of the respective cells.

In the series arrangement of cells as shown in FIG. 4, twelve separate cell units are shown held in tight, side-by-side, series arrangement within the housing 15. The anode of the cell nearest the end plate 12 receives current directly from the end plate 12 via the retainer plate 31, and the current is passed through such cell to the cathode. The current is then transferred directly to the anode of the next cell unit in the series through the separator plate 23. In like manner, the current successively passes through all the cell units, and is finally transferred through the retainer plate 30 to the end plate 11.

Means are provided for applying fluid such as water to the grooves 22 in the anode plates 17. As mentioned hereinbefore, the grooves 22 extend in generally parallel relationship across the surface of each of the anodes 17 from near one edge to near the outer edge thereof. This allows fluid flow through the grooves generally across the anode plate. In the series of cells, as shown in FIG. 4, the anodes of the respective cell units are oriented so that the grooves are in generally parallel relationship from cell to cell, so that fluid can be admitted to the grooves 22 on one side of the series of cells, flow through the grooves 22, and then exit the grooves 22 from the other side of the series of cells. Means are provided for applying the fluid to the grooves 22 on one side of the cells and receiving the flow of fluid on the other side of the cells. In the preferred embodiment illustrated in the drawings, the means for providing fluid to the grooves 22 and for receiving the flow of fluid is incorporated into the housing 15.

Figure 3:
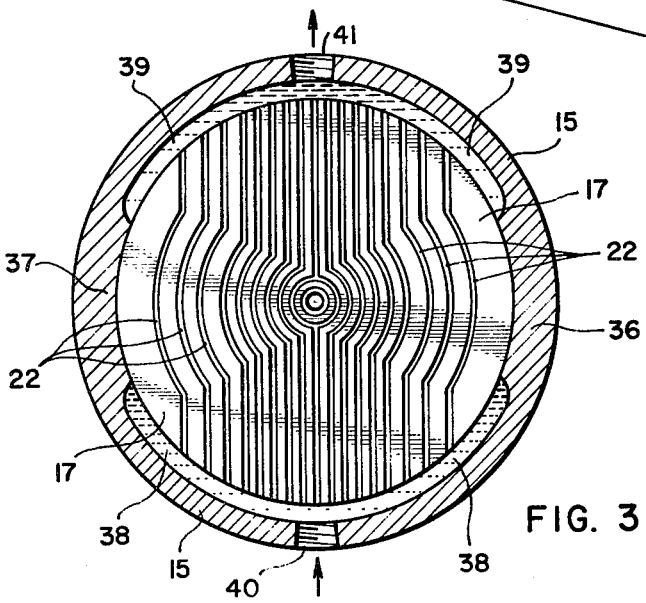
FIG. 3 is a cross-sectional view taken on line 3—3 of FIG. 1 and showing the grooved face of one of the anodes in the apparatus.

Referring in particular to FIG. 3, the cylindrical housing 15 has a pair of longitudinally extending ridges 36 and 37 on opposite inside surfaces. The ridges 36 and 37 contact the perimeter of the series of cells and separate the annular space between the series of cells and the housing 15 into two chambers 38 and 39. The chamber 38 forms a channel extending generally longitudinally along one side of the series of cells so as to be in flow communication with the grooves 22 in the anode plates 17 on that side, and, thus, adapted to convey a liquid such as water to the grooves 22. The chamber 39 forms a channel on the opposite side of the apparatus which extends generally longitudinally along the opposite side of the series of cells so as to be in flow communication with the grooves 22 in the anode plates 17 on that side, and, thus, adapted to receive a flow of liquid such as water from the grooves 22. The flow of liquid into and out of the chambers 38 and 39, respectively, is shown by small arrows in FIG. 3.

A threaded opening 40 (FIG. 3) is provided through the housing 15 in communication with chamber 38 for providing a supply of fluid to that chamber. Likewise, a threaded opening 41 (FIGS. 1 and 3) is provided through the housing 15 in communication with chamber 39 for withdrawing fluid from that chamber.

Fluid such as water flowing through the grooves 22 permeates the porous anode plates 17 and wets the membranes 18. Electrolysis products such as oxygen produced at the interface of the membranes 18 and anode plates 17 diffuse through the porous anode plates and are carried away with the water flowing through the grooves 22 in the anode plates 17. Application of water to the interfaces between the anode plates 17 and membranes 18, together with the application of direct current to the anode plates 17, causes an electrolytic reaction resulting in the production of oxygen and hydronium ions. As mentioned above, the oxygen diffuses through the anode plates 17 and exits the cells with the water flowing through the grooves 22. The hydronium ions migrate through the membranes 18 to the interface between the membranes 18 and the cathode plates 16, where they combine with electrons supplied by the cathode plates 16 to produce water and hydrogen. The water and hydrogen which is so produced flow through the porous cathode plates 16 to the elongate cavity 24 extending through the central portion of the series of cells. The annular gaskets 21, preferably D-rings, seal the opening through the anode plates 17 from the plates 17 themselves, thus, preventing flow of oxygen into the elongate cavity 24 or the flow of hydrogen into the anode plates 17.

The end plate 11 has a central bore therethrough which is in communication with the elongate cavity 24, and means is provided for connecting the opening in the end plate 11 with appropriate conduit means (not shown) for transporting water and hydrogen from the apparatus. As illustrated, a tight fitting insert 42 is positioned in the opening in end plate 12. The insert 42 can be of the same material as the retainer plate 30, or, if electrical isolation with the piping which is to be connected to the insert 42 is desired, the insert 42 can be made of an electrically nonconducting material such as an appropriate polymeric material. A threaded opening is provided in the insert 42 so that a conduit can be attached thereto. The inside face of the end plate is advantageously provided with a counterbore, and the insert 42 has a flanged end which fits within the counterbore. A sealing ring 43 is provided within an appropriate receptacle in the inner face of the insert to provide a liquid and gas tight seal between the insert 42 and the retainer plate 30. A small central opening extends from the threaded opening in the insert 42 as illustrated for communication with the elongate cavity 24.

Inasmuch as the end plates 11 and 12 are used to convey current to and from the series of cells in the housing 15 of the preferred embodiment, insulating washers 44 (FIGS. 1 and 4) are provided which are adapted to maintain an air gap between the end of the tie bolts 13 and the corresponding openings in the end plate 11 through which the tie bolts 13 pass, so that there is no electrical conducting path other than through the series of cells between the two end plates 11 and 12. If desired, plastic collars can also be provided around the tie bolts 13 to prevent electrical contact between the bolts 13 and the end plates 11 and 12.

Improved electrolytic reaction efficiency can be obtained if so desired by providing appropriate catalytic surfaces on the respective anode plates 17 and cathode plates 16. The surfaces of the respective anode plates 17 which contact mutually respective membranes 18 can be coated with a member selected from the group consisting of lead dioxide, platinum, palladium, iridium, rhodium, and alloys or mixtures thereof. The surfaces of the respective cathode plates 16 which contact the mutually respective membranes are coated with a member selected from the group consisting of platinum, nickel, iron, palladium, and alloys or mixtures thereof. The coatings on both the anode and cathode plates is made in a manner so that the porosity of the plates is maintained. It has been found advantageous to electroplate the surfaces of the cathode and anode plates with a very thin layer of the catalytic material.

The flow of water through the grooves 22 not only provides water for the electrolytic reaction occurring in the cell, but also provides efficient cooling of the cell. Cell temperatures are easily controlled by controlling the temperature of the water introduced into the apparatus to flow through the grooves 22. The design of the apparatus provides efficient water distribution to the cells therein. The sealing arrangement at the outer edges of the cathode plates and at the openings through the anode plates allows high pressure operation of the cell on the hydrogen outlet, i.e., from the elongate cavity through the series of cells, while preventing leakage problems from the high pressure hydrogen side to the low pressure oxygen side of the cells. High pressure operation of the cell is also achieved without puncturing the polymer membranes 18, inasmuch as both sides of the respective membranes 18 are supported by flat plates having no ridges or grooves in contact with the membranes. The large surface contact between the anode plates 17 and the membranes 18 and between the cathode plates 16 and the membranes permits maximum quantity of products produced for the size of the cell. The construction of the apparatus is relatively simple, with the components being easily and relatively inexpensively produced. By making the cathode plates 16, anode plates 17, spacer plates 23, retainer plates 30 and 31, and end plates 11 and 12 of electrochemically compatible metallic materials as explained hereinbefore, and by making the other components which contact the above-named elements of non-metallic, nonconducting materials, corrosion of the metallic electrical conducting elements is virtually eliminated, and the apparatus becomes reliable and efficient over extended periods of operation.

The spacing of the grooves 22 between the anode plates and the respective plates which contact the sides of the anode plates, as well as the number and size of the grooves, are not per-se critical. The number of and size of the grooves will depend primarily on the size of the components of the electrode structure. The only requirement being that there are sufficient number of grooves of a sufficient size to provide the desired rate of flow of fluid through the cell. The spacing of the grooves also depends upon size and shape configurations of the components of the electrode structure. The spacing should be sufficient to provide generally uniform liquid distribution over the anode plate. Optimum spacing can be readily determined experimentally with the actual size and shape components which are to be used in the electrode structure.

The end plates 11 and 12 are made of a material which is electrically conducting. It is advantageous to make the end plates 11 and 12 of the same material which the separator plates 23 and retainer plates 30 and 31 are made of.

We claim:

1. An electrode structure for electrolysis apparatus in which the cathode and anode are disposed, respectively, on either side of and in contact with a solid polymer electrolyte membrane, said electrode structure comprising:

a cathode plate composed of an electrically conductive material which has been formed so as to be porous, whereby the cathode plate is capable of being permeated by a liquid such as water;

a first annular sealing ring circumscribing the perimeter of the cathode plate;

a flat, retainer ring having substantially the same thickness as the thickness of said cathode plate, said flat ring circumscribing the perimeter of said first sealing ring;

a solid polymer electrolyte membrane one side of which is disposed in contact with the one side of said cathode plate, with said membrane extending outwardly beyond the perimeter of said cathode and beyond said first sealing ring, so that the perimeter of the membrane is substantially coterminous with the perimeter of said flat ring;

an anode plate composed of a porous, electrically conductive material, said anode plate having one side thereof disposed in contact with the other side of said membrane, with the perimeter of said anode plate being substantially coterminous with the perimeter of said membrane;

an elongate flow passage extending through said cell structure from one end thereof to the other, said elongate passage comprising concentrically aligned bores through the cathode plate, membrane, and anode plate, with the bore in said anode having a larger diameter than the bores in said membrane which is in contact with the side of said anode, so as to form an indented annular groove around the flow passage;

a second annular sealing ring positioned within said annular groove in the flow passage;

means for securing the cathode plate, membrane, and anode plate in firm, side-by-side, series engagement;

means for applying a liquid to the porous anode plate to flow therethrough;

wherein said liquid flowing through said porous anode wets the membrane, products produced at the interface of the membrane and anode diffuse through the porous anode and are carried away with the liquid, and products produced at the interface of the membrane and the cathode diffuse through the porous cathode to said flow passage, and means for applying a D.C. current to the cathode and anode.

2. An electrode structure in accordance with claim 1, further comprising:

a flat plate composed of an electrically conductive material which has been formed so as to be solid and non-porous, said flat plate being positioned with one side thereof in contact with the other side of said anode plate, with the perimeter of said flat plate being substantially coterminous with the perimeter of said anode;

a plurality of grooves between said anode plate and said flat plate, with said grooves extending in generally parallel relationship across the interface between said anode plate and said flat plate;

means for securing the cathode plate, membrane, anode plate, and said flat plate in firm, side-by-side, series engagement; and means for applying a fluid to said grooves to flow therethrough;

wherein liquid flows through said grooves, with the liquid permeating the porous anode so as to wet the membrane, and products produced at the interface of the membrane and anode diffuse through the porous anode and are carried away with the liquid flowing through said grooves.

3. An electrode structure in accordance with claim 1, wherein the flat plate is made of a member selected from the group consisting of non-porous titanium, non-porous nickel, non-porous graphite and alloys thereof, and the anode plate and cathode plate are made of a member selected from the group consisting of sintered titanium, sintered nickel, porous graphite, and mixtures thereof.

4. An electrode structure in accordance with claim 1, wherein the surface of the anode plate which contacts the membrane is coated with an anodic material in a manner so that the anode plate maintains its porosity.

5. An electrode structure in accordance with claim 4, wherein the surface of the cathode plate which contacts the membrane is coated with a cathodic material in a manner so that the cathode plate maintains its porosity.

6. An electrode structure in accordance with claim 2, wherein the surface of the anode plate which contacts the membrane is coated with a member selected from the group of lead dioxide, platinum, palladium, iridium, rhodium, and mixtures and alloys thereof, and the surface of the cathode plate which contacts the membrane is coated with a member selected from the group consisting of platinum, nickel, iron, palladium, and mixtures and alloys thereof, said coatings of both anode and cathode plates being made in a manner so as to maintain the porosity of the respective plates.

7. An electrode structure in accordance with claim 2, wherein said grooves are formed in the surface of the side of said anode plate which contacts said flat plate.

8. An electrolyser comprising:

a plurality of anode plates composed of a porous, electrically conductive material, each of the anode plates having a bore therethrough from one side thereof to the other, a plurality of solid polymer electrolyte membranes, each of said membranes having the same general shape with substantially the same surface dimensions as said anode plates, so that the membranes can be arranged side-by-side to said anode plates, with the perimeters of the anode plates and membranes being substantially coterminous, and each of said membranes having a bore therethrough from one side thereof to the other;

a plurality of cathode plates composed of a porous, electrically conductive material, each of said cathode plates having the same general shape as said anode plates and said membranes but being slightly smaller in surface dimension than said anode plates and said membranes, each of said cathode plates having a bore therethrough from one side thereof to the other;

a plurality of annular sealing rings, one sealing ring for each cathode plate, said sealing rings being adapted to circumscribe the perimeter of said cathode;

a plurality of flat, retainer rings, one flat ring for each cathode plate, said flat rings being adapted to circumscribe the perimeter of the sealing rings on said cathodes;

a plurality of solid, non-porous spacer plates composed of an electrically conductive material said spacer plates having the same general shape with substantially the same surface dimensions as said anode plates and said membranes, so that the spacer plates can be arranged side-by-side to said anode plates, with the perimeters of the anode plates and spacer plates being substantially coterminous, each of said spacer plates having a bore therethrough from one side thereof to the other side;

means for securing the anode plates, solid polymer electrolyte membranes, cathode plates, and spacer plates in side-by-side relationship to form a plurality of cells each respective cell comprising an anode plate, a solid polymer electrolyte membrane, and a cathode plate, with one side of the anode plate being in contact with one side of the solid polymer electrolyte membrane and the other side of said membrane being in contact with one side of the cathode plate, said cells being connected in series, with the spacer plates positioned between respective cells and with said anode plates, solid polymer electrolyte membranes, cathode plates, and spacer plates all being aligned so that the respective bores therethrough are in concentric alignment to form an elongate, cylindrical collection cavity extending substantially from one end of the series of cells to the other end of the series of cells;

means for conveying a liquid to said anode plates to flow therethrough;

first means for receiving liquid and products produced at the interfaces of the membranes and anodes;

second means in combination with said elongate collection chamber for receiving products produced at the interfaces of the membranes and cathode plates; and means for applying a D.C. current to the anode and cathode plates.

9. An electrolyser in accordance with claim 8, further comprising a plurality of grooves formed between each of the anode plates and the mutually respective spacer plates in contact therewith, wherein said grooves extend in generally parallel relationship across the interface between the respective anode plates and spacer plates, and wherein said means of conveying liquid to the anode plates is adapted to convey the liquid to said grooves.

10. An electrolyser in accordance with claim 9, wherein said grooves are formed in the surface of the respective sides of said anode plates which contact the sides of said spacer plates.

11. An electrolyser in accordance with claim 9, wherein the anode and cathode plates are made of a member selected from the group consisting of sintered titanium, sintered nickel, porous graphite, and mixtures and alloys thereof, and the spacer plates are made of a member selected from the group consisting of non-porous titanium, non-porous nickel, non-porous graphite, and mixtures and alloys thereof.

12. An electrolyser in accordance with claim 9, wherein the surfaces of the respective anode plates which contact mutually respective membranes are coated with an anodic material in a manner so that the anode plates maintain their porosity.

13. An electrolyser in accordance with claim 9, wherein the surfaces of the respective cathode plates which contact mutually respective membranes are coated with a cathodic material in a manner so that the cathode plates maintain their porosity.

14. An electrolyser in accordance with claim 9, wherein the surfaces of the respective anode plates which contact mutually respective membranes are coated with a member selected from the group consisting of lead dioxide, platinum, palladium, iridium, rhodium, and mixtures and alloys thereof, and the surfaces of the respective cathode plates which contact the mutually respective membranes are coated with a member selected from the group consisting of platinum, nickel, iron, palladium, and mixtures and alloys thereof, said coatings of both the anode and cathode plates being made in a manner so as to maintain the porosity of the anode and cathode plates.

15. An electrolyser in accordance with claim 9, wherein said anode plates, cathode plates, and spacer plates are generally circular and said grooves extend from near one side of the series of cells to near the other side of the series of cells;

wherein said liquid conveying means comprises first channel means extending generally longitudinally along said one side of the series of cells so as to be in flow communication with and adapted to convey liquid to said grooves;

wherein said first receiving means comprises second channel means extending generally longitudinally along said other side of the series of cells so as to be in flow communication with said grooves and adapted to receive liquid and products produced at the respective interfaces of the membranes and the anode plates.

16. An electrolyser in accordance with claim 15 wherein a cylindrical housing is positioned around the longitudinal perimeter of the series of cells, said housing having a pair of longitudinally extending ridges on the opposite inside surface of the housing, with the ridges projecting inwardly, so that the ridges contact the perimeter of the series of cells thereby separating the annular space between the housing and the series of cells into two chambers which form said first and second channel means, and the housing is positioned around the series of cells so that the first chamber is in communication with said grooves along said one side of the series of cells and said second chamber is in communication with said grooves along said other side of the series of cells;

wherein means are provided at the opposite ends of the housing for closing and sealing the otherwise open ends of said first and second chambers;

wherein water supply means are provided for supplying a flow of water to said first chamber; and wherein means are provided for withdrawing water and products produced at the respective interfaces of the membranes and anode plates from said chamber.

17. An electrolyser in accordance with claim 16, wherein two end flange plates are provided, said end plates positioned flatwise against the otherwise exposed flat ends of the series of cells and having sufficient surface dimensions such that the perimeter of the respective end plates extends beyond the longitudinal perimeter of the series of cells, wherein means are provided for urging the end plates towards each other and into firm forced contact with the respective ends of the series of cells as well as into firm forced contact with the respective ends of said housing, so that the cells in the series of cells is maintained in secured position and the end plates form the closed, sealed ends of said first and second chambers; and wherein an opening is provided through one of the end plates into communication with the elongate, cylindrical cavity within the series of cells.

18. An electrolyser in accordance with claim 17, wherein each of the end plates has a series of spaced bores positioned around and adjacent to the perimeter of said plate, so that the bores in one end plate can be concentrically aligned with mutually respective bores in the other end plate; and wherein tie bolts are provided extending through the mutually respective bores in said end plates for urging the end plates toward each other.

19. An electrolyser in accordance with claim 18, wherein the tie bolts are electrically insulated from the respective end plates, and the means for applying a D.C. current to the anode and cathode plates comprises means for connecting a D.C. potential to one of the end plates and means for connecting a D.C. potential which is negative with respect to said first potential to the other end plate.

20. An electrolyser in accordance with claim 19, wherein the opening through the one end plate is provided with a counterbore on the side of said one plate which contacts the series of cells;

wherein an insert is provided to fit in said opening with a flanged end which fits within the counterbore portion of said opening, said insert being made of a material which is an electrical insulator or electrochemically compatible with the anodes and cathodes, said insert having a central bore therethrough which communicates with the elongate cylindrical cavity in the series of cells; and wherein an elastomeric gasket is provided between the inner face of said insert and the series of cells so as to provide a fluid and gas tight seal therebetween.

21. An electrolyser comprising:

an anode plate composed of a porous, electrically conductive material, said anode plate having a bore therethrough from one side thereof to the other, a solid polymer electrolyte membrane, said membrane having the same general shape with substantially the same surface dimensions as said anode plate, so that the membrane can be arranged side-by-side to said anode plate, with the perimeters of the anode plate and membrane being substantially coterminous, and each of said membrane having a bore therethrough from one side thereof to the other;

a cathode plate composed of a porous, electrically conductive material, said cathode plate having the same general shape as said anode plate and said membrane but being slightly smaller in surface dimension than said anode plate and said membrane each of said cathode plates having a bore therethrough from one side thereof to the other;

an annular sealing ring, one sealing ring for each cathode plate, said sealing rings being adapted to circumscribe the perimeter of said cathode; p1 a flat, retainer ring, one flat ring for each cathode plate, said flat rings being adapted to circumscribe the perimeter of the sealing rings on said cathodes;

means for securing the anode plate, solid polymer electrolyte membrane, and cathode plate in side-by-side relationship to form a cell, wherein the side of the anode plate is in contact with one side of the solid polymer electrolyte membrane and the other side of said membrane is in contact with one side of the cathode plate, with said anode plate, solid polymer electrolyte membrane, and cathode plate being aligned so that the respective bores therethrough are in concentric alignment to form a collection cavity extending through the cell;

means for conveying a liquid to said anode plates to flow therethrough;

first means for receiving liquid and products produced at the interface of the membrane and anode;

second means in combination with said elongate collection chamber for receiving products produced at the interface of the membrane and cathode plate; and means for applying a D.C. current to the anode and cathode plates.

* * * * *